US008448943B2

(12) United States Patent
Prabhat et al.

(10) Patent No.: US 8,448,943 B2
(45) Date of Patent: May 28, 2013

(54) CARRIAGE RESET FOR UPCOMING SHEET

(75) Inventors: Saurabh Prabhat, Webster, NY (US); Joannes N. M. deJong, Hopewell Junction, NY (US); Lloyd A. Williams, Mahopac, NY (US)

(73) Assignee: Xerox Corporation, Norwalk, CT (US)

( * ) Notice: Subject to any disclaimer, the term of this patent is extended or adjusted under 35 U.S.C. 154(b) by 523 days.

(21) Appl. No.: 12/406,203

(22) Filed: Mar. 18, 2009

(65) Prior Publication Data

US 2010/0237558 A1 Sep. 23, 2010

(51) Int. Cl.
*B65H 7/02* (2006.01)

(52) U.S. Cl.
USPC ..... 271/227

(58) Field of Classification Search
USPC ..... 271/227, 228, 230, 248, 249, 250, 271/252, 253, 254
See application file for complete search history.

(56) References Cited

U.S. PATENT DOCUMENTS

| | | | | |
|---|---|---|---|---|
| 5,994,711 | A | 11/1999 | Seachman et al. | |
| 6,032,004 | A | 2/2000 | Mirabella, Jr. et al. | |
| 6,173,952 | B1 * | 1/2001 | Richards et al. | 271/228 |
| 6,373,042 | B1 | 4/2002 | Kretschmann et al. | |
| 6,533,268 | B2 | 3/2003 | Williams et al. | |
| 6,817,609 | B2 * | 11/2004 | Halvonik et al. | 271/228 |
| 7,422,211 | B2 | 9/2008 | DeJong et al. | |
| 7,845,635 | B2 * | 12/2010 | Herrmann | 271/228 |
| 2008/0237974 | A1 | 10/2008 | Mandel et al. | |
| 2008/0296835 | A1 | 12/2008 | Dejong et al. | |
| 2010/0123284 | A1 * | 5/2010 | Herrmann | 271/227 |

* cited by examiner

*Primary Examiner* — Thomas Morrison
(74) *Attorney, Agent, or Firm* — Gibb & Riley, LLC

(57) ABSTRACT

A method and system feeds sheets through a media path in a process direction and moves a laterally movable sheet registration carriage (positioned within the media path) in a lateral direction perpendicular to the process direction. It determines the lateral error of the sheets within the media path before the sheets enter the sheet registration carriage, using first sensors positioned within the media path. This allows the sheet registration carriage to be moved to a variable lateral starting position (as opposed to a consistent reset position or centered reset position) before the sheets enter the sheet registration carriage based on the error of the sheets as determined by the first sensors. The error can be the amount of lateral error, or simply can be a classification of lateral error (right error, left error, etc.).

12 Claims, 4 Drawing Sheets

CARRIAGE RESET FOR UPCOMING SHEET

BACKGROUND AND SUMMARY

Embodiments herein generally relate to printers and copiers or reproduction machines, and more particularly, concerns a system and method for aligning sheets within the media path and more particularly to embodiments that provide a prediction of the best lateral location for a movable registration carriage that depends upon the position of the next upcoming sheet.

Certain sheet registration devices within media paths of printers and copiers require part of the registration device, in this case the carriage which performs the cross-process direction movement, to correct for sheet lateral error. The carriage also undergoes a reset move back to some home position after it registers a sheet. This is normally done in the inter-document zone (IDZ) gap. One approach is to go back to the same reset position (nominal zero, or centered position) always, irrespective of the next sheet misalignment error. As a result, the carriage sometimes must travel a large distance to correct for worst case errors in either direction of the nominal.

The embodiments herein provide a sensing system and a method that enables the computation of a location to which the carriage is positioned in the cross-process (lateral) direction before the sheet enters the carriage. The sensing system measures the lateral error of the upcoming sheet and computes the appropriate pre-position location for the carriage that minimizes carriage movement. The carriage control system then moves the carriage to that location. This reduces the range of total carriage motion significantly.

More specifically, embodiments herein feed sheets through a media path in a process direction and move a laterally movable sheet registration carriage (positioned within the media path) in a lateral direction perpendicular to the process direction. The embodiments herein determine the error of the sheets within the media path before the sheets enter the sheet registration carriage, using first sensors positioned within the media path. This allows the embodiments herein to move the sheet registration carriage to a variable lateral starting position (as opposed to a consistent reset position or centered reset position) before the sheets enter the sheet registration carriage based on the error of the sheets as determined by the first sensors. The error can be the amount of lateral error, or simply can be a classification of lateral error (right error, left error, etc.).

Once the sheets enter the sheet registration carriage, the embodiments herein determine the amount of misalignment of the sheets using second sensors positioned within the sheet registration carriage. This allows the embodiments herein to align the sheets to a predetermined lateral position within the media path based on the amount of the misalignment, using the sheet registration carriage.

While the sheet registration carriage is commonly reset to the center position (or other consistent lateral reset position); the embodiments herein do not reset the sheet registration carriage to a consistent lateral reset position. Instead, the embodiments herein move the sheet registration carriage to a variable starting position that is different than the center of the media path. The variable starting position is thus different than the normal lateral reset location of the sheet registration carriage. The variable lateral starting position comprises an anticipated carriage location that minimizes lateral range of the sheet registration carriage and maximizes effectiveness of sheet alignment operations of the sheet registration carriage.

System embodiments herein utilize a media path feeding sheets in a process direction and a laterally movable sheet registration carriage positioned within the media path. The sheet registration carriage is movable in a lateral direction perpendicular to the process direction. The system also includes first sensors positioned within the media path. The first sensors are operatively connected to the sheet registration carriage. The first sensors determine the error of the sheets within the media path before the sheets enter the sheet registration carriage.

The sheet registration carriage moves to a variable lateral starting position before the sheets enter the sheet registration carriage based on the error of the sheets as determined by the first sensors. Again, the error can comprise the amount of lateral error or simply the classification of lateral error.

Further, the system includes second sensors adjacent to the sheet registration carriage. The second sensors are operatively connected to the sheet registration carriage. The second sensors determine the amount of misalignment of sheets within the sheet registration carriage. The sheet registration carriage aligns the sheets to a predetermined lateral position within the media path based on the amount of the misalignment.

Some embodiments herein can be more complex and can precisely move the carriage to any specific lateral position along the full movement range of the carriage. For example, the sensors can provide a very detailed report of the exact lateral distance of misalignment of the next upcoming sheet. These sophisticated embodiments move the carriage to a more precise location depending upon the lateral distance measurement produced by the sensors.

Other embodiments can be more simplified (and more cost effective) and can more simply pre-position the carriage in just a limited number of preset positions depending upon the classification of a lateral error. For example, the classification can be as simple as whether or not there is a lateral error (of sufficient magnitude). In such embodiments, the sensors can simply report whether the sheet lateral position is greater or less than some predetermined misalignment level (e.g., plus or minus one-half the maximum lateral position error relative to nominal). If the predetermined misalignment level is not exceeded, such a simplified system will reset the carriage to the center position. To the contrary if the predetermined misalignment level is exceeded, these more simplified embodiments reset the carriage to a one-half the maximum offset from center (in the misalignment direction).

These and other features are described in, or are apparent from, the following detailed description.

BRIEF DESCRIPTION OF THE DRAWINGS

Various exemplary embodiments of the systems and methods are described in detail below, with reference to the attached drawing figures, in which.

DETAILED DESCRIPTION

Many sheet registration devices need to reset some of their internal kinematic components to a proper starting position in preparation for receiving and registering the next sheet. During sheet registration these components move away from such a starting position.

An example of this is a registration device that includes a movable registration carriage. Such a device moves the whole carriage carrying the registration nips and sheet during registration in the cross-process direction. In order to have the same range of cross-process direction movement available for the next sheet, the carriage moves back to the nominal starting position before receiving the next sheet. This is normally done in the inter-document zone gap.

The embodiments herein provide a sensing system and a method that enables the computation of a location to which the carriage is positioned in the cross-process (lateral) direction before the sheet enters the carriage. The sensing system measures the lateral error of the upcoming sheet and computes the appropriate pre-position location for the carriage that minimizes carriage movement. The carriage control system then moves the carriage to that location. This reduces the amount of total carriage motion range significantly.

Figure 1:
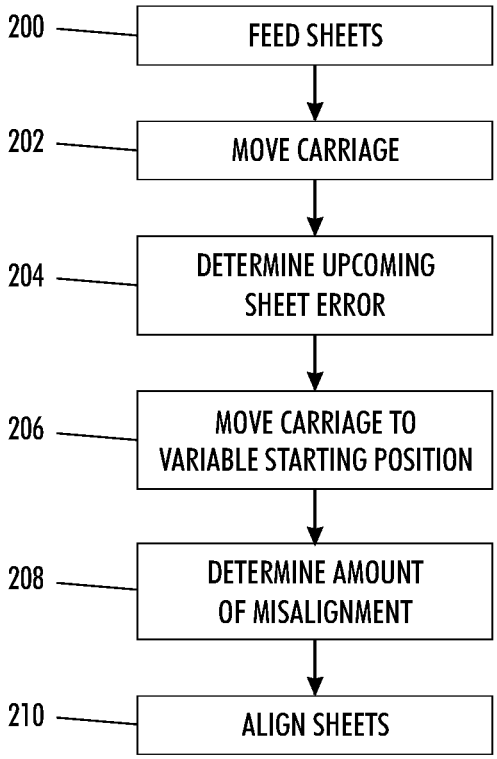
FIG. 1 is a flow diagram illustrating embodiments herein.

More specifically, as shown in flowchart form in FIG. 1, embodiments herein feed sheets through a media path in a process direction (item 200) and move a laterally movable sheet registration carriage (positioned within the media path) in a lateral direction perpendicular to the process direction (item 202) potentially to a reset or starting position.

In item 204, the embodiments herein determine the error of the sheets within the media path before the sheets enter the sheet registration carriage, using first sensors positioned within the media path. This allows the embodiments herein to, in item 206, move the sheet registration carriage to a variable lateral starting position (as opposed to a consistent reset position or centered reset position) before the sheets enter the sheet registration carriage based on the error of the sheets as determined by the first sensors. The error can be the amount of lateral error, or simply can be a classification of lateral error (right error, left error, etc.).

Once the sheets enter the sheet registration carriage, the embodiments herein determine the amount of misalignment of the sheets using second sensors positioned within the sheet registration carriage (item 208). This allows the embodiments herein to align the sheets to a predetermined lateral position within the media path based on the amount of the misalignment, using the sheet registration carriage in item 210 and the process repeats.

Figure 2:
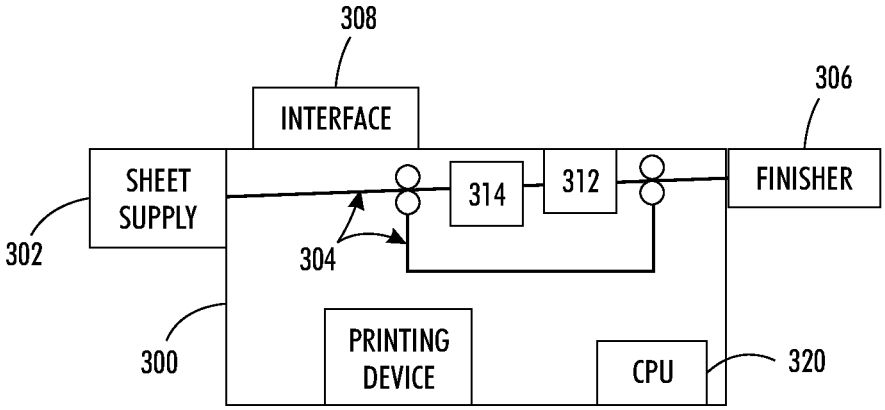
FIG. 2 is a schematic diagram of a printing apparatus according to embodiments herein.

FIG. 2 illustrates a printing apparatus 300 that includes a printing engine 312 (e.g., an electrostatic and xerographic printing engine) and a media path 304. The media path 304 transports sheets of print media to and from (relative to) the printing engine 312 (e.g., from a sheet supply 302, through a registration (alignment) unit 314, through the printing engine 312, and finally to a finisher 306). The media path 304 can include belts, rollers, or any other mechanism for moving media sheets. Item 308 illustrates the user interface and item 310 represents the processor (central processing unit (CPU)). The processor is a computerized device and includes at least one computer storage media that stores instructions that the processor 310 executes to control the operations of the various components within the printer 300. The processor 300 is be connected to the sensors, drive rollers, registrations units, etc. and causes the actions described herein to occur.

Figure 3:
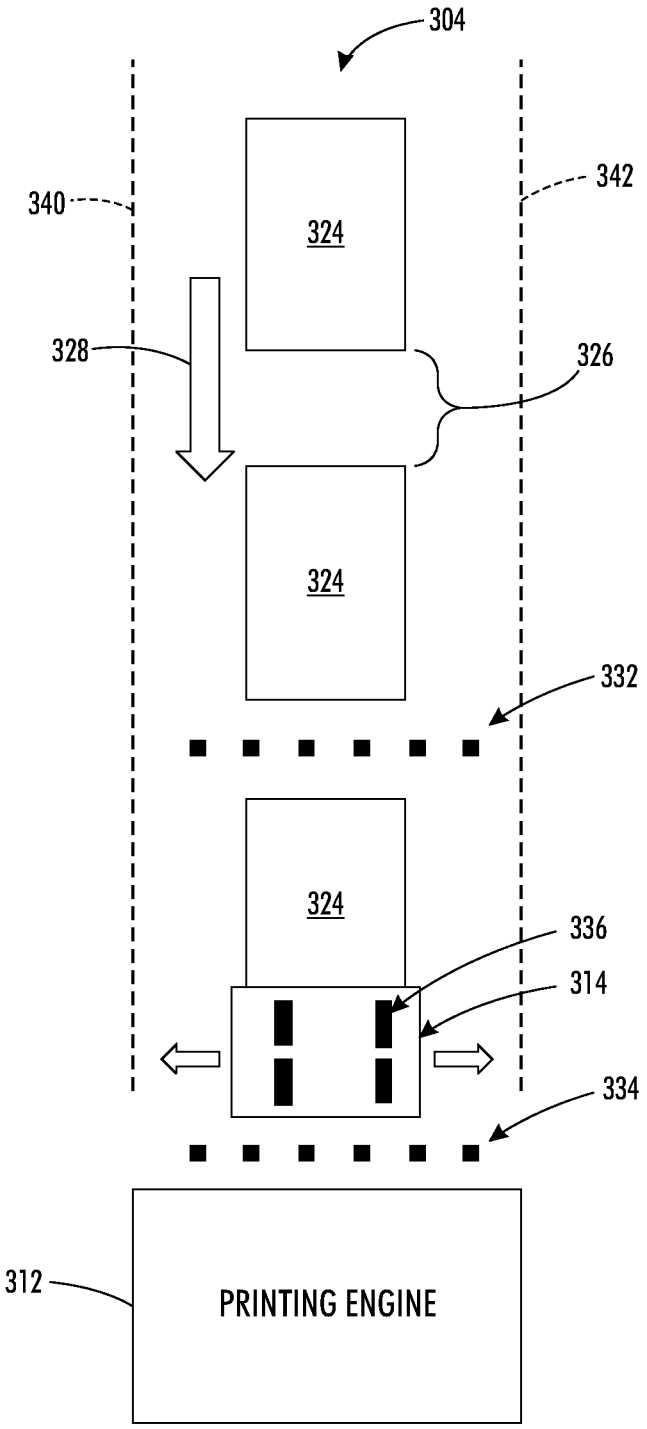
FIG. 3 is a schematic diagram of a media path and alignment apparatus according to embodiments herein.

As shown in FIG. 3, system embodiments herein utilize the media path 304 to feed sheets 324 in a process direction (arrow 328) and a laterally movable sheet registration carriage 314 positioned within the media path 304. The inter-document zone gap is illustrated by 326. The sheets 324 can comprise any form of sheets, including paper, plastic, card stock, etc.

The sheet registration carriage 314 is movable in a lateral direction perpendicular to the process direction 328 from one extreme 340 (first side) of the media path 304 to another extreme 342 (second side) of the media path 304. Details regarding sheet registration are known. For example, see U.S. Pat. No. 7,422,211 and U.S. Patent Publication Number 2008/0296835, 2008/0237974, and the patents and publications mentioned therein (the complete disclosures of which are incorporated herein by reference).

The system also includes first sensors 332 positioned within the media path 304. All the sensors discussed herein can comprise individual sensors, pairs of sensors, arrays of sensors, etc. The choice of what type of sensor to be used is primarily based on cost, power, and space considerations. The first sensors 332 are operatively connected to the sheet registration carriage 314. The first sensors 332 are positioned at a sufficient distance from the sheet registration carriage 314 so that the first sensors 332 can determine the error of the sheets 324 within the media path 304 before the sheets 324 enter the sheet registration carriage 314.

The sheet registration carriage 314 moves to a variable lateral starting position (as indicated by the arrows in the drawings) before the sheets 324 enter the sheet registration carriage 314 based on the error of the sheets 324 as determined by the first sensors 332. Again, the error can comprise the amount of lateral error or simply the classification of lateral error.

Further, the system includes second sensors 334 positioned adjacent to the sheet registration carriage 314. The second sensors 334 are operatively connected to the sheet registration carriage 314. The second sensors 334 determine the amount of misalignment of sheets 324 within the sheet registration carriage 314. The sheet registration carriage 314 aligns the sheets 324 using, for example, rollers 336 to a predetermined lateral position within the media path 304 based on the amount of the misalignment.

Figure 4:
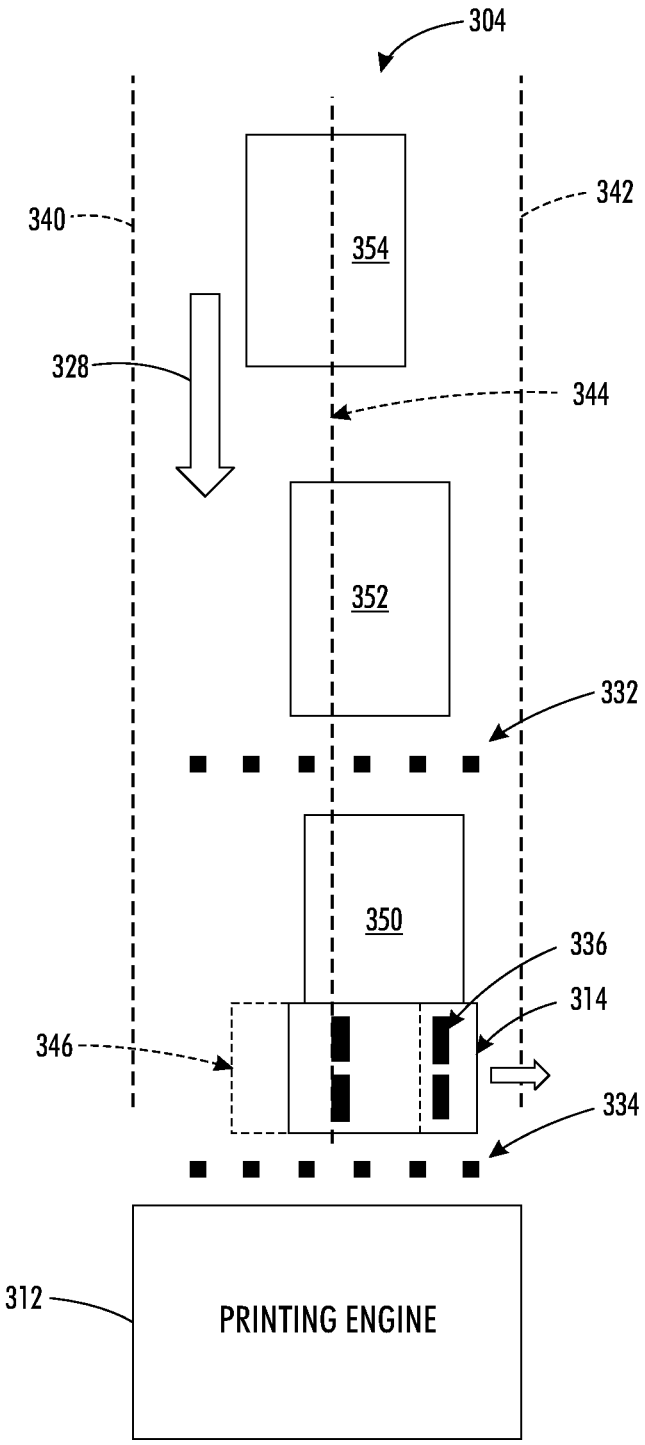
FIG. 4 is a schematic diagram of a media path and alignment apparatus according to embodiments herein.

While the sheet registration carriage 314 is commonly reset to the center position (or other consistent lateral reset position); the embodiments herein do not reset the sheet registration carriage 314 to a consistent lateral reset position. For example, FIG. 4 illustrates the centerline 344 of the media path 304 and also illustrates a dashed box 346 that represents the position of the sheet registration carriage 314 when it is positioned along the center line 344 of the media path 304. This position 346 could be established as the conventional reset (centered, zero) position for the sheet registration carriage 314.

Instead of returning to the reset position 346 for each inter-document zone gap 326, the embodiments herein move the sheet registration carriage 314 to a variable starting position that is constantly changing and that is often different than the center 344 of the media path 304. The variable starting position is thus different than the normal lateral reset location 346 of the sheet registration carriage 314. The variable lateral starting position comprises an anticipated carriage 314 location that minimizes lateral movement of the sheet registration carriage 314 and maximizes effectiveness of sheet alignment operations of the sheet registration carriage 314.

As shown in FIG. 4, the sheet 350 that is within the sheet registration carriage 314 is closer to the second side 342 of the media path 304 and, therefore, the sheet registration carriage 314 has moved laterally toward the second side 342 of the media path 304. Now, the sheet registration carriage 314 can move the sheet laterally to align it with the desired reference position using one or more sensors 334 to determine the reference position. The next sheet 352 is also biased toward the second side 342 of the media path 304.

Conventional systems would return the sheet registration carriage 314 to the reset position 346 after sheet 350 has exited the sheet registration carriage 314, and such conventional systems would then move the sheet registration carriage 314 from the reset position 346 back towards the second side 342 of the media path 304 in order to align the next upcoming sheet 352.

However, rather than returning the sheet registration carriage 314 back to the reset position 346 after sheet 350 has exited the sheet registration carriage 314, the embodiments herein leave the sheet registration carriage 314 biased toward the second side 342 of the media path because, by the time sheet 350 exits the sheet registration carriage 314, the first sensors 332 would have detected that the next upcoming sheet 352 is biased toward the second side 342 of the media path 304. This process performed by the embodiments herein eliminates unnecessary movements of the sheet registration carriage 314 back to the reset position 346 and then back again toward the second side 342 of the media path 304 in situations similar to those illustrated by FIG. 4. By eliminating unnecessary movements of the sheet registration carriage 314, the durability of the alignment mechanism is dramatically increased. Further, this also reduces the amount of power that the device will consume by reducing the amount power consumed by the actuators that move the sheet registration carriage 314. Note: there are 2 instantiations 1) as described in 0036 where the carriage does not go to the reset position before prepositioning occurs and 2) the carriage does go to the reset position before prepositioning occurs. Both instantiations reduce the range of motion. Selection of one or the other depends on timing analysis for a specific embodiment.

Some embodiments herein can be more complex and can precisely move the carriage 314 to any specific lateral position along the full movement range of the carriage 314 (fully from side 340 to side 342). For example, the first sensors 332 can provide a very detailed report of the exact lateral distance of misalignment of the next upcoming sheet 352. These sophisticated embodiments move the carriage 314 to a very precise location anywhere between side 340 and side 342 depending upon the lateral distance measurement produced by the sensors.

Other embodiments can be more simplified (and more cost effective) and can more simply pre-position the carriage 314 in just a limited number (e.g., 3, 5, 7, etc.) of predetermined variable positions depending upon the classification of a lateral error. Thus, the predetermined variable positions could comprise only left, center, and right (3 total); two to the left, one center, two to the right (5 total), etc.

For example, the classification can be as simple as whether or not there is a lateral error (of sufficient magnitude). In such embodiments, the sensors can simply report whether the sheet lateral position is greater or less than some predetermined misalignment level (e.g., plus or minus one-half the maximum lateral position error (340 or 342) relative to nominal 344). If the predetermined misalignment level is not exceeded, such a simplified system will reset the carriage to the center reset position 344. To the contrary, if the predetermined misalignment level is exceeded, these more simplified embodiments reset the carriage to one-half the maximum offset from center (halfway between 340 and 344 or halfway between 344 and 342) in the misalignment direction.

As mentioned above, movable carriage registration systems are known. For example, and U.S. Pat. No. 6,533,268 (the complete disclosure of which is incorporated herein by reference) discloses a movable carriage registration system similar to the one illustrated in FIG. 5 and U.S. Patent Publication Number 2008/0296835 discloses a movable carriage registration system similar to the one illustrated in FIG. 6.

Figure 5:
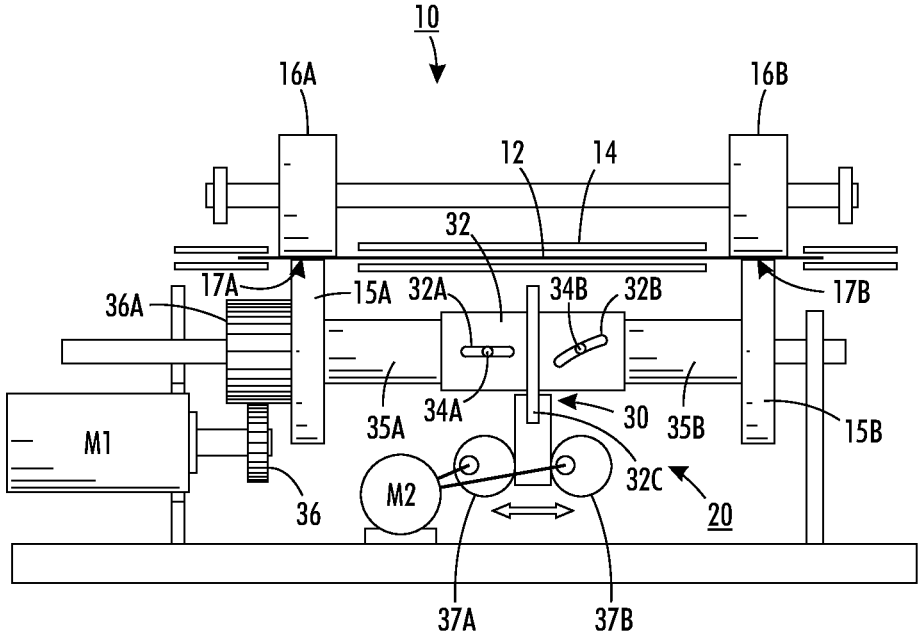
FIG. 5 is a schematic diagram of an alignment apparatus according to embodiments herein.

In FIG. 5, the sheet deskewing systems are for deskewing a sequence of sheets 12 and exemplary baffles 14 partially defining an exemplary printer 10 paper path are illustrated. Two laterally spaced sheet drive rollers 15A, 15B, the single servo-motor M1 sheet drive for both, and their mating idler rollers 16A, 16B forming the first and second drive nips 17A, 17B are shown in FIG. 5. Also, the small, low cost, low power, differential actuator drive motor M2 is shown.

These deskewing system embodiments drive the two drive nips 17A, 17B at the same rotational speed to feed the sheet 12 in those nips downstream in the paper path at the process speed, except when the need for deskewing that sheet 12 is detected by the optical sensors. That is, when the sheet 12 has arrived in the deskewing system in a skewed condition needing deskewing, a corresponding pitch change by a driving difference between the two drive roller 15A, 15B, rotary positions is made during the time the sheet 12 is passing through, and held in, the two sheet feeding nips 17A, 17B to accomplish deskew.

Any of these illustrated deskewing systems (or only key components thereof) may simply be mounted on simple lateral rails, rods or carriages so as to be laterally driven by any of various such direct or indirect driving connections with another such servo-motor. These embodiments provide said paper deskewing by said differential nip action through a simple and low cost differential mechanism system 30.

Here, in this deskewing system embodiment that differential system 30 comprises a pin-riding helically slotted sleeve connector 32 which is laterally transposed by the small low cost differential motor M2. This particular example is a tubular sleeve connector 32 having two slots 32A, 32B, at least one of which is angular, partially annular or helical. These slots 32A, 32B respectively slideably contain the respective projecting pins 34A, 34B of the ends of the respective split co-axial drive shafts 35A, 35B over which the tubular sleeve connector 32 is slideably mounted. Each drive roller 15A, 15B is mounted to, for rotation with, a respective one of the drive shafts 35A, 35B, and one of those drive shafts, 34A here, is driven by the motor M1, here through the illustrated gear drive 36 although it could be directly. The two drive shafts 35A, 35B may themselves be tubular, to further reduce the system mass.

This variable pitch differential connection mechanism 30 enables a paper registration system that enables only one forward drive motor M1 to positively drive both nips 17A and 17B. Only the motor M1 needs to have the necessary power to propel the paper in the forward direction, while second much smaller, motor M2 does not need to drive the sheet forward, and only needs to provide enough power to operate the differential system 30 to correct for the sheet skew.

That differential system 30 is small, accurate, inexpensive, and requires little power to operate. It may be actuated by any of numerous possible simple mechanisms simply providing a short linear movement. For example, motor M2 rotates opposing cams 37A, 37B by the desired amount to move the tubular sleeve 32 (as by engagement with its projecting flange or arm 32C), laterally to change by the angle of the slot 32B the relative angular positions of the two pins 34A, 34B, and thereby correspondingly change the relative angular positions of their two shafts 35A, 35B, and thereby differentially rotate one drive roller 15B relative to the other drive roller 15A to provide the desired deskewing of the sheet 12 by the difference between the two nips. Yet both rollers 15A and 15B otherwise continue to be driven, to drive the sheet 12 in the process direction at the same speed, by the same motor M1, because the sleeve 32 is positive drive connecting shaft 35A to shaft 35B by the pins 34A and 34B engaged in the slots 32A and 32B of the shared sleeve 32.

Figure 6:
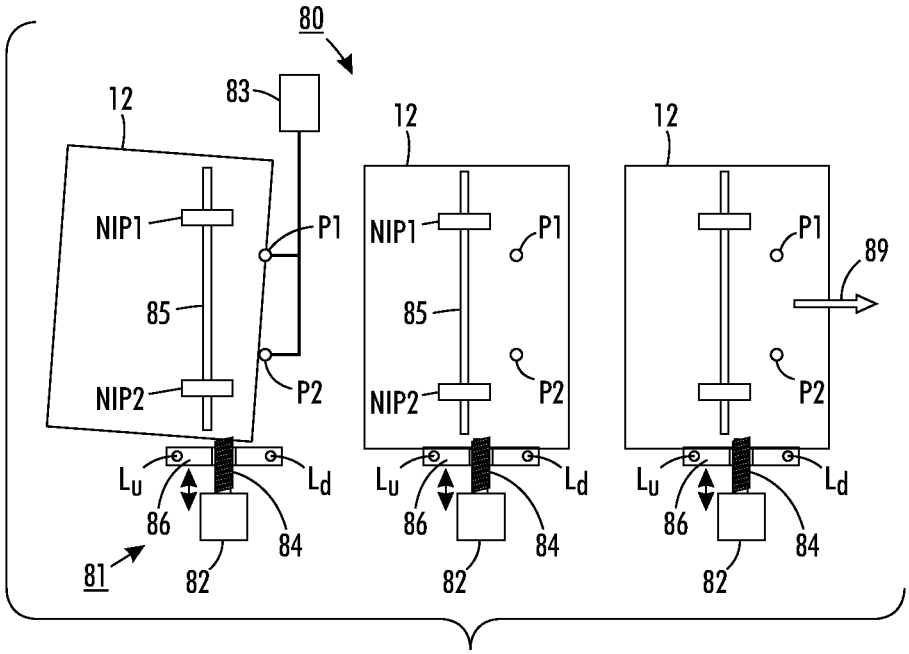
FIG. 6 is a schematic diagram of an alignment apparatus according to embodiments herein.

FIG. 6 shows a moving carriage lateral registration system 80 that enables active deskew of a sheet. Registration takes place in three primary phases as shown from left to right in FIG. 6. System 80 includes nips NIP 1 and NIP 2 that drive sheet 12 in the process direction of arrow 89. Sensors P1 and P2 detect the arrival of sheet 12 in the nips and start the lateral and skew registration.

The amount of skew is detected by the difference in time at which the leading edge of the sheet passes each of the sensors. That time difference represents a distance that directly relates to the amount of angular skew of the sheet. The outputs of sensors P1 and P2 are supplied to controller 83 that evaluates the amount of skew and provides an appropriate control signal to a conventional stepping motor (not shown) that in turn provides appropriate directional information such that the angular position of NIP 1 to NIP 2 about axis of rotation 85 is precisely changed to change the angular position of the sheet. The angular adjustment of NIP 1 with respect to NIP 2 takes place while the nips continue to drive the sheet, at high speed, towards a handoff point. A conventional differential drive mechanism useful in practicing this disclosure is shown in U.S. Pat. No. 5,278,624 and is incorporated herein by reference.

Simultaneously, a pair of sensors Lu and Ld mounted on a bar 86 that is connected to a rotatable screw 84 are moved (either inboard or outboard depending on the sheet position, as indicated by the double headed arrow) to "find" the top edge of the sheet. Sensors Lu and Ld send signals to controller 83 that, in turn, actuates motor 82 which through screw mechanism 84 moves bar 86 and the sensors to find the top edge of the sheet. Translating carriage 81 is controlled to follow the sheet to maintain the sensor position relative to the top edge of the sheet while the sheet is actively deskewed Many computerized devices are discussed above. Computerized devices that include chip-based central processing units (CPU's), input/output devices (including graphic user interfaces (GUI), memories, comparators, processors, etc. are well-known and readily available devices produced by manufacturers such as Dell Computers, Round Rock Tex., USA and Apple Computer Co., Cupertino Calif., USA. Such computerized devices commonly include input/output devices, power supplies, processors, electronic storage memories, wiring, etc., the details of which are omitted here from to allow the reader to focus on the salient aspects of the embodiments described herein. Similarly, scanners and other similar peripheral equipment are available from Xerox Corporation, Norwalk, Conn., USA and the details of such devices are not discussed herein for purposes of brevity and reader focus.

The word "printer" or "image output terminal" as used herein encompasses any apparatus, such as a digital copier, bookmaking machine, facsimile machine, multi-function machine, etc. which performs a print outputting function for any purpose. The details of printers, printing engines, etc. are well-known by those ordinarily skilled in the art and are discussed in, for example, U.S. Pat. No. 6,032,004, the complete disclosure of which is fully incorporated herein by reference. The embodiments herein can encompass embodiments that print in color, monochrome, or handle color or monochrome image data. All foregoing embodiments are specifically applicable to printers and/or xerographic machines and/or processes.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims can encompass embodiments in hardware, software, and/or a combination thereof. Unless specifically defined in a specific claim itself, steps or components of the embodiments herein should not be implied or imported from any above example as limitations to any particular order, number, position, size, shape, angle, color, or material.

What is claimed is:

1. An apparatus comprising:

a media path feeding sheets in a process direction;

a laterally movable sheet registration carriage positioned within said media path, said sheet registration carriage being movable in a lateral direction perpendicular to said process direction;

at least one first sensor positioned within said media path, said at least one first sensor being operatively connected to said sheet registration carriage via a controller, said at least one first sensor determining a lateral position of said sheets within said media path before said sheets enter said sheet registration carriage, said controller moving said sheet registration carriage to a variable lateral starting position before said sheets enter said sheet registration carriage based on said lateral position of said sheets as determined by said at least one first sensor, said variable starting position constantly changing for different sheets of the same size depending upon said lateral position of said sheets within said media path, and said controller moving said variable starting position to locations different than a reset position, locations being centered relative to said sheets, and also locations different than being centered relative to said sheets; and at least one second sensor adjacent to said sheet registration carriage, said at least one second sensor being operatively connected to said sheet registration carriage via said controller, said at least one second sensor determining an amount of misalignment of sheets within said sheet registration carriage, said controller moving said sheet registration carriage to align said sheets to a predetermined lateral position within said media path based on said amount of said misalignment.

2. The apparatus according to claim 1, said variable lateral starting position comprising an anticipated carriage location that minimizes lateral range of said sheet registration carriage.

3. The apparatus according to claim 1, said variable starting position comprising an anticipated carriage location that maximizes effectiveness of sheet alignment operations of said sheet registration carriage.

4. An apparatus comprising:

a media path feeding sheets in a process direction;

a laterally movable sheet registration carriage positioned within said media path, said sheet registration carriage being movable in a lateral direction perpendicular to said process direction;

at least one first sensor positioned at said media path, said at least one first sensor being operatively connected to said sheet registration carriage via a controller, said at least one first sensor determining an error of said sheets within said media path before said sheets enter said sheet registration carriage, said controller moving said sheet registration carriage to a variable lateral starting position before said sheets enter said sheet registration carriage based on said error of said sheets as determined by said at least one first sensor, said error comprising one of an amount of lateral error and a classification of lateral error, said variable starting position constantly changing for different sheets of the same size depending upon said error of said sheets, and said controller moving said variable starting position to locations different than a reset position, locations being centered relative to said sheets, and also locations different than being centered relative to said sheets; and at least one second sensor positioned within said sheet registration carriage, said at least one second sensor being operatively connected to said sheet registration carriage via said controller, said at least one second sensor determining an amount of misalignment of sheets within said sheet registration carriage, said controller moving said sheet registration carriage to align said sheets to a predetermined lateral position within said media path based on said amount of said misalignment.

5. The apparatus according to claim 4, said variable lateral starting position comprising an anticipated carriage location that minimizes lateral range of said sheet registration carriage.

6. The apparatus according to claim 4, said variable starting position comprising an anticipated carriage location that maximizes effectiveness of sheet alignment operations of said sheet registration carriage.

7. A method comprising:

feeding sheets by a media path in a process direction;

moving, using a controller, a laterally movable sheet registration carriage positioned within said media path in a lateral direction perpendicular to said process direction;

determining a lateral position of said sheets within said media path before said sheets enter said sheet registration carriage using at least one first sensor that is connected to said controller and positioned within said media path;

moving, using said controller, said sheet registration carriage to a variable lateral starting position before said sheets enter said sheet registration carriage based on said lateral position of said sheets as determined by said at least one first sensor, said variable starting position constantly changing for different sheets of the same size depending upon said lateral position of said sheets within said media path, and said controller moving said variable starting position to locations different than a reset position, locations being centered relative to said sheets, and also locations different than being centered relative to said sheets; and determining an amount of misalignment of sheets within said sheet registration carriage using at least one second sensor that is connected to said controller and positioned adjacent to said sheet registration carriage; and aligning said sheets to a predetermined lateral position within said media path based on said amount of said misalignment, using said sheet registration carriage.

8. The method according to claim 7, said variable lateral starting position comprising an anticipated carriage location that minimizes lateral range of said sheet registration carriage.

9. The method according to claim 7, said variable starting position comprising an anticipated carriage location that maximizes effectiveness of sheet alignment operations of said sheet registration carriage.

10. A method comprising:

feeding sheets by a media path in a process direction;

moving, using a controller, a laterally movable sheet registration carriage positioned within said media path in a lateral direction perpendicular to said process direction;

determining an error of said sheets within said media path before said sheets enter said sheet registration carriage using at least one first sensor that is connected to said controller and positioned within said media path;

moving, using said controller, said sheet registration carriage to a variable lateral starting position before said sheets enter said sheet registration carriage based on said error of said sheets as determined by said at least one first sensor, said error comprising one of an amount of lateral error and a classification of lateral error, said variable starting position constantly changing for different sheets of the same size depending upon said error of said sheets, and said controller moving said variable starting position to locations different than a reset position, locations being centered relative to said sheets, and also locations different than being centered relative to said sheets; and determining an amount of misalignment of sheets within said sheet registration carriage using at least one second sensor that is connected to said controller and positioned adjacent to said sheet registration carriage; and aligning said sheets to a predetermined lateral position within said media path based on said amount of said misalignment, using said sheet registration carriage.

11. The method according to claim 10, said variable lateral starting position comprising an anticipated carriage location that minimizes lateral range of said sheet registration carriage.

12. The method according to claim 10, said variable starting position comprising an anticipated carriage location that maximizes effectiveness of sheet alignment operations of said sheet registration carriage.

* * * * *